United States Patent [19]

Crane

[11] 4,425,676

[45] Jan. 17, 1984

[54] CUSHION TO REDUCE THE INCIDENCE OF DECUBITUS ULCERS IN IMMOBILIZED PATIENTS

[76] Inventor: Robert L. Crane, 200 Lewiston Rd., Kettering, Ohio 45429

[21] Appl. No.: 356,575

[22] Filed: Mar. 9, 1982

[51] Int. Cl.[3] ..... A47C 27/08; A61G 7/04

[52] U.S. Cl. ..... 5/450; 5/453; 5/455; 5/469

[58] Field of Search ..... 5/449, 450, 453, 454, 5/455, 456, 457, 468, 469

[56] References Cited

U.S. PATENT DOCUMENTS

| | | | |
|---|---|---|---|
| 1,382,831 | 6/1921 | Hilker | 5/449 |
| 3,428,973 | 2/1969 | Margest et al. | 5/469 |
| 3,459,179 | 8/1969 | Olesen | 128/60 |
| 3,462,775 | 8/1969 | Markwitz et al. | 5/449 |
| 3,608,961 | 9/1971 | Von Meck | 5/450 |
| 3,757,366 | 9/1973 | Sacher | 5/423 |
| 3,983,587 | 10/1976 | Gorran | 5/451 |

FOREIGN PATENT DOCUMENTS

| | | | |
|---|---|---|---|
| 934078 | 9/1973 | Canada | 5/450 |

*Primary Examiner*—Alexander Grosz

*Attorney, Agent, or Firm*—Donald J. Singer; John R. Flanagan

[57] ABSTRACT

A cushion for reducing the incidence of decubitus ulcers in immobilized patients has upper and lower sheets peripherally seamed together to form an enclosure which contains a quantity of small plastic spheres or beads. A baffle system is arranged within the enclosure for maintaining the beads in an even distribution throughout the enclosure. The material of the baffle system and upper sheet is permeable to air flow, while the lower surface is not, whereby air may be forced to flow through the enclosure and out the upper sheet from a blower interconnected to an end of the enclosure by a duct.

5 Claims, 3 Drawing Figures

CUSHION TO REDUCE THE INCIDENCE OF DECUBITUS ULCERS IN IMMOBILIZED PATIENTS

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The present invention broadly relates to the prevention and/or alleviation of decubitus ulcers (bed sores) in patients confined to beds for extended periods of time, and, more particularly, is concerned with an improved cushion for facilitating the same.

2. Description of the Prior Art

An ever-present concern in the care of long-term bedridden patients is the possible development of decubitus ulcers or bed sores. They result from the pressure exerted on the skin and subcutaneous tissues by the skeletal bony prominences and the object on which the patient rests, such as a mattress. This pressure produces tissue anoxia or ischemia. The cutaneous tissues are progressively broken down leading to destruction of underlying soft tissue. Once this ulcer forms it is quite painful and very slow to heal. Bacterial infection are difficult to avoid and frequently prolong the healing process.

Several items have been devised for the purpose of alleviating the pressure over the bony prominences. The most frequently used items may be categorized as pressure spreading cushions, such as sheepskins, soft foam rubber and gel filled pads. These cushion devices suffer from two defects.

First, except for the gel filled pads, they do not evenly distribute pressure by increasing the contact area. The ideal situation would be to suspend the patient in a fluid without contacting it. This is attempted with the gel filled pad, but containment of the fluid only aggravates the other defect.

Second, these devices limit air circulation to the skin in contact with the cushion. The sheepskin is compressed by the weight of the patient and the pads and foam rubber trap and hold perspiration next to the skin, thereby accelerating the skin breakdown.

The ideal cushion would, therefore, be one that supports the patient in the manner of a fluid, but also permits free air circulation to the skin in contact with the cushion. U.S. Pat. No. 3,757,366 to Sacher discloses a cushion in which means are provided to facilitate circulation of air to the areas of patient contact with the cushion. However, the Sacher cushion falls far short of providing means to support the patient in the manner of a fluid. U.S. Pat. No. 3,459,179 to Olesen discloses a pad filled with plastic beads that will adapt to the shape of the supported part of the patient's body, but no provision is made for circulating air to the contact area.

Therefore, a need exists for a cushion to support a bedridden patient which ideally would have the conforming properties of a fluid and the permeability to gas flow of ordinary cotton cloth.

SUMMARY OF THE INVENTION

The present invention provides a cushion designed to satisfy the aforementioned need. The invention uniquely solves the problem of high contact pressure that occurs between the patient's body and a cushioning media while also allowing the circulation of air to the contact area.

The formation of decubitus ulcers is almost solely due to high contact pressure and moisture at the contact areas between the patient and cushion upon which he or she rests. This invention evolves a new cushion which conforms to the patient's body, thus alleviating high contact pressures, and also permits rapid air flow to the skin/cushion interface to limit or eliminate moisture (perspiration) accumulation at that site. Solid lightweight spherical particles or beads are used in the cushion to distribute contact pressure and thus prevent decubitus ulcer formation in the patient. A ducted fan or blower is connected to the cushion enclosure for providing an air flow to either minimize the accumulation of perspiration between the patient's skin and the cushion, or to carry vaporous medication to the contact areas, thus aiding a healing process or preventing a degradation process. The cushion includes a unique baffle system which maintains a relatively uniform distribution of the particles or beads throughout the enclosure for facilitating the alleviation of high contact pressures, without impeding the flow of air to the contact areas.

Accordingly, the present invention is directed to a cushion for reducing the incidence of decubitus ulcers in immobilized patients, which comprises the combination of: (a) an enclosure formed by an upper sheet of material permeable to air and a lower sheet of material impermeable to air, the lower sheet being connected at its periphery to the periphery of the upper sheet; (b) a quantity of loose filler material, such as small plastic particles or beads, contained within the enclosure; (c) means for directing a flow of air into the enclosure; and (d) a baffle system within the enclosure between the upper and lower sheets thereof and being arranged so as to limit migration of the filler material away from high contact pressure areas caused by the shape and weight distribution of a patient lying on the upper sheet of the enclosure, while allowing passage of air flow through the enclosure and out the upper sheet thereof. More particularly, the baffle system is in the form of a series of strips of material some of which are permeable to air, connected between the upper and lower sheets of the enclosure, and arranged generally across the direction of air flow.

DETAILED DESCRIPTION OF THE INVENTION

Figure 1:
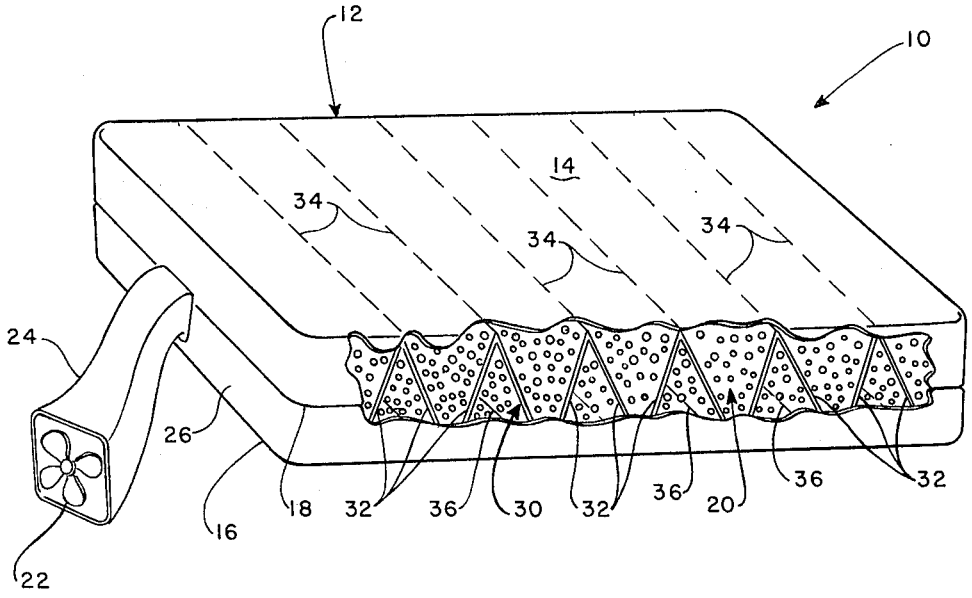
FIG. 1 is a perspective view of the cushion comprising the present invention, with portions cut away to show the small particles and baffle system located in the interior of the cushion.

Referring now to the drawings, and more particularly to FIG. 1, there is shown the preferred embodiment of the cushion of the present invention, being generally designated 10.

The cushion 10 includes an enclosure 12 formed by an upper sheet 14 and a lower sheet 16 connected at its periphery by a seam 18 to the periphery of the upper sheet. The upper sheet 14 is composed of flexible material permeable to air, such as cotton cloth, while the lower sheet 16 is composed of material impermeable to air, such as plastic or canvas fabric.

Contained within the enclosure 12 of the cushion 10 is a quantity of loose filler material, generally designated 20. Preferably, the filler material 20 takes the form of small lightweight plastic particles, spheres beads or the like which may be of varying size ranging from 0.5 to 3 mm in diameter, or be predominately of one size within this range. The small beads are quite mobile and will move very much like a fluid or gel to conform to the shape and weight of the body of the patient lying on the cushion 10. The plastic beads may be fabricated from any one of a number of possible plastics. In one experimental model of the cushion, polystyrene was the plastic chosen because of its low density, low cost and crushable characteristics. Because of their spherical configuration the particles or beads of the filler material 20 may be reasonably packed within the enclosure 12 and still only fill 40 to 60 percent of the volume of the enclosure.

As a result, rapid air flow may be directed throughout the void areas in the filler material within the enclosure 12 from a fan or blower 22 interconnected to the enclosure by a duct 24. As seen in FIG. 1, the blower 22 directs the air flow through one end 26 of the enclosure and toward an opposite end 28. The permeability of the upper sheet 14 offers an avenue of escape of the air out through the upper sheet. Since during normal use of the cushion 10 a patient would be resting on the upper sheet, the air flow would impinge on the areas of contact between the patient's skin and the upper sheet 14 and serve to eliminate the accumulation of perspiration at such areas.

To counteract redistribution or migration of the small particles or beads away from a relatively even or uniform distribution throughout the enclosure, a baffle system, generally designated 30, is incorporated by the cushion 10 between the upper and lower sheets 14, 16 of its enclosure 12. Air flow and/or the variation of pressure caused by the particular shape and weight distribution of a patient's body may tend to cause migration of the small beads of filler material 20 away from high pressure areas. The baffles 32 serve to limit the redistribution of the beads into uneven patterns. Each baffle 32 takes the form of a strip of material, such as the same material forming the upper surface 16, which in at least preselected portions is permeable to air and is connected by seams 34, 36 to, and extends between, the upper and lower sheets 16, 18. Preferably, the baffle strips 32 are arranged in approximately parallel fashion, generally across or transversely to the direction of air flow from the one end 26 to the opposite end 28 of the enclosure. Since some of the material of the baffles is permeable to air, the air flow throughout the enclosure 12 is not impeded to any significant degree, while the distribution of filler material 20 is maintained in substantially even amounts between the successive baffle strips. By providing selected portions of the baffles permeable to air, flow of air through the upper sheet 16 can be concentrated at selected areas thereof which will contact the pressure areas of the patient's body.

Figure 2:
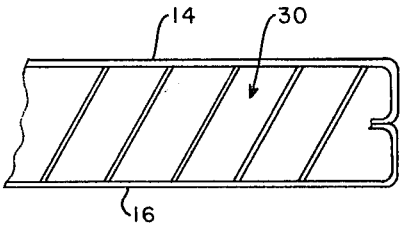
FIG. 2 is a schematical fragmentary side view of a first alternative configuration of the baffle system.
Figure 3:
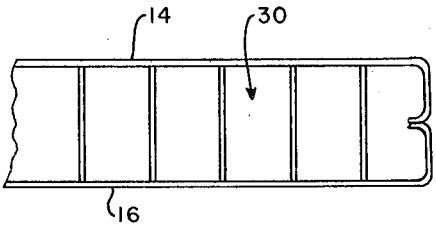
FIG. 3 is a schematical fragmentary side view of a second alternative configuration of the baffle system.

Several different configurations of the baffle system are possible as alternates to the one illustrated in FIG. 1 which may be characterized as a vee construction. A first alternate configuration, called slant tube construction, is shown in FIG. 2, while a second alternate configuration, named a boxed type construction, is depicted in FIG. 3.

From the foregoing description and accompanying drawings, it will surely be understood that the cushion 10 of the present invention has three important characteristics. These are: (1) it permits rapid air flow to the skin/cushion contact areas; (2) it contains a filler material which allows a circulating air flow supporting the patient with conforming properties approaching that of a liquid; and (3) it limits the migration of the material away from high pressure areas of contact caused by the particular shape and weight distribution of the patient. Furthermore, the cushion may have beneficial effects in other applications, one being in the case of burn patients. Various gaseous medications could be added to the forced air flow to aid in the treatment of certain skin conditions, such as burns.

It is thought that the invention and many of its attendant advantages will be understood from the foregoing description and it will be understood that various changes may be made in the form, construction and arrangement of the parts described without departing from the spirit and scope of the invention or sacrificing all of its material advantages, the form hereinbefore described being merely an exemplary embodiment thereof.

Having thus described the invention, what is claimed is:

1. A cushion for reducing the incidence of decubitus ulcers in immobilized patients, comprising:

(a) an enclosure formed by an upper sheet of flexible material permeable to air and a lower sheet of material impermeable to air, said lower sheet being connected at its periphery to the periphery of said upper sheet;

(b) a quantity of loose filler material contained within said enclosure;

(c) means for directing a flow of air into said enclosure; and (d) a baffle system within said enclosure in the form of a series of strips of material being connected between said upper and lower sheets of said enclosure and arranged generally across the direction of air flow and so as to limit migration of said filler material away from high pressure areas caused by the shape and weight distribution of a patient lying on said upper sheet of said enclosure, said material of said strips being at least partially permeable to air for allowing passage of air flow across said baffle system, through said enclosure and out said upper sheet thereof.

2. The cushion as recited in claim 1, wherein said loose filler material is in the form of small plastic beads.

3. The cushion as recited in claim 1, wherein said air flow directing means includes a blower and a duct interconnecting said blower and one end of said enclosure for directing said air flow toward an opposite end of said enclosure.

4. The cushion as recited in claim 1, wherein said material of said baffle system strips is substantially the same as the material of said upper sheet.

5. A cushion for reducing the incidence of decubitus ulcers in immobilized patients, comprising:

(a) an enclosure formed by an upper sheet of flexible material permeable to air and a lower sheet of material impermeable to air, said lower sheet being connected at its periphery to the periphery of said upper sheet;

(b) a quantity of small beads contained within said enclosure;

(c) a blower;

(d) a duct interconnecting said blower to an end of said enclosure for directing a pressurized flow of air into said enclosure and out through said upper sheet thereof; and (e) a baffle system in the form of a series of strips of material, at least partially permeable to air and substantially the same as the material of said upper enclosure sheet, being connected between said upper and lower sheets of said enclosure and arranged generally across the direction of air flow from said blower and so as to limit migration of said beads away from high pressure areas caused by the shape and weight distribution of a patient lying on said upper sheet of said enclosure.

* * * * *